US006676113B2

(12) United States Patent
Christensen et al.

(10) Patent No.: US 6,676,113 B2
(45) Date of Patent: Jan. 13, 2004

(54) CONTROL BARRIER WITH ROTATABLE LEGS

(75) Inventors: Marc E. Christensen, Salt Lake City, UT (US); Eric M. Simon, Salt Lake City, UT (US)

(73) Assignee: Off the Wall Products, LLC, Salt Lake City, UT (US)

( * ) Notice: Subject to any disclaimer, the term of this patent is extended or adjusted under 35 U.S.C. 154(b) by 0 days.

(21) Appl. No.: 09/971,964

(22) Filed: Oct. 4, 2001

(65) Prior Publication Data

US 2002/0014619 A1 Feb. 7, 2002

Related U.S. Application Data

(63) Continuation-in-part of application No. 09/577,404, filed on May 22, 2000, now abandoned, which is a continuation-in-part of application No. 08/974,001, filed on Nov. 19, 1997, now Pat. No. 6,086,285, which is a continuation-in-part of application No. 08/841,467, filed on Apr. 22, 1997, now Pat. No. 5,993,103.

(51) Int. Cl.[7] ..... E04H 17/16

(52) U.S. Cl. ..... 256/25; 256/67; 160/351

(58) Field of Search ..... 256/1, 19, 24, 256/25, 26, 27, 59, 65.01; 403/109.1, 109.2, 109.3, 109.8; 160/351

(56) References Cited

U.S. PATENT DOCUMENTS

| | | | | |
|---|---|---|---|---|
| 1,049,261 | A | | 12/1912 | Pelissier |
| 1,655,539 | A | | 1/1928 | Freedman |
| 2,161,193 | A | | 6/1939 | Phillips |
| 2,451,875 | A | * | 10/1948 | Ryder |
| 2,788,596 | A | | 4/1957 | Schwartz |
| 2,794,375 | A | | 6/1957 | DiFalco et al. |
| 2,893,148 | A | | 7/1959 | Figman |
| 2,960,055 | A | | 11/1960 | Tomek |
| 3,090,976 | A | | 5/1963 | Liu |
| 3,141,655 | A | | 7/1964 | Platt |
| 3,284,122 | A | | 11/1966 | Rich |

(List continued on next page.)

FOREIGN PATENT DOCUMENTS

| | | | | | |
|---|---|---|---|---|---|
| AT | B-50241/93 | | | 8/1994 | |
| DE | 1 658 470 | | | 12/1970 | |
| EP | 407277 | | | 1/1991 | |
| EP | 0 442 249 | A1 | | 8/1991 | |
| EP | 550362 | | | 7/1993 | |
| FR | 2312602 | A | * | 1/1977 | ..... E01F/13/00 |
| FR | 2 619 400 | | | 2/1989 | |
| FR | 2 660 945 | A1 | | 10/1991 | |
| FR | 2 663 657 | | | 12/1991 | |
| FR | 2708639 | A1 | * | 2/1995 | ..... E01F/13/02 |
| FR | 2 743 825 | A1 | | 7/1997 | |
| FR | 2772803 | A1 | * | 6/1999 | ..... E01F/13/02 |
| GB | 942 255 | | | 11/1963 | |
| GB | 1 482 634 | | | 8/1977 | |
| GB | 2 084 635 | | | 4/1982 | |
| GB | 2 219 332 | A | | 12/1989 | |
| GB | 2 237 832 | A | | 5/1991 | |
| GB | 2 240 801 | | | 8/1991 | |
| GB | 2 282 836 | | | 4/1996 | |
| JP | 3-125708 | | | 5/1991 | |

*Primary Examiner*—Gregory J. Binda
*Assistant Examiner*—Ryan M. Flandro
(74) *Attorney, Agent, or Firm*—Workman Nydegger

(57) ABSTRACT

A control barrier is provided having a barrier wall with one or two support assemblies attached thereto. The barrier wall has a front face with a display recess, wind ports, and tenons and mortises formed thereon. The barrier wall also has a set of projecting arms having either pins or ports to allow a series of control barriers to be connected together. The support assemblies are positionable between a support position and a standing position. Preferably, the support assemblies include a leg and a foot. The leg is extendable and/or rotatable to allow the foot to be positioned between a support position and a standing position.

30 Claims, 8 Drawing Sheets

U.S. PATENT DOCUMENTS 3,503,600 A 3/1970 Rich
3,540,699 A 11/1970 Guzzardella
3,572,465 A 3/1971 Olson
3,661,359 A 5/1972 Walker
3,672,657 A 6/1972 Young et al.
3,767,167 A * 10/1973 Rasmussen ..... 256/26
3,822,954 A 7/1974 Ansgariusson
3,856,268 A 12/1974 Fitch
3,880,406 A 4/1975 Stehle et al.
4,124,196 A * 11/1978 Hipskind ..... 256/1
4,138,095 A 2/1979 Humphrey
4,169,688 A 10/1979 Toshio
4,279,105 A 7/1981 Cameron
4,298,186 A 11/1981 Glass
4,348,133 A 9/1982 Trent et al.
4,380,327 A 4/1983 Fish
4,423,854 A 1/1984 Cobb et al.
4,435,106 A 3/1984 Förster et al.
4,500,225 A 2/1985 Quittner
4,624,210 A 11/1986 Glass
4,646,807 A * 3/1987 Doublet ..... 256/24 X
4,665,673 A 5/1987 Diana
4,681,302 A 7/1987 Thompson
4,773,629 A 9/1988 Yodock
4,796,369 A 1/1989 Hamann
4,854,767 A 8/1989 Sasaki
4,869,617 A 9/1989 Chiodo
4,917,219 A 4/1990 Henry
4,925,333 A 5/1990 Bishop
4,943,035 A 7/1990 Thomson et al.
4,944,060 A 7/1990 Perry et al.
4,946,306 A 8/1990 Yodock
4,974,815 A 12/1990 Glass
4,978,245 A 12/1990 White
5,009,541 A * 4/1991 Thurston
5,011,325 A 4/1991 Antonioli
5,031,683 A * 7/1991 Marvy et al.
5,054,507 A * 10/1991 Sparks
5,106,554 A 4/1992 Drews
5,118,216 A 6/1992 Smith
5,122,008 A 6/1992 Drews
5,123,773 A 6/1992 Yodock
5,208,585 A 5/1993 Sprague
5,213,312 A 5/1993 MacDonald
5,226,439 A 7/1993 O'Keeffe et al.
5,269,623 A 12/1993 Hanson
D349,738 S 8/1994 Maegele, III et al.
5,387,049 A 2/1995 Duckett
5,402,988 A * 4/1995 Eisele ..... 256/24
5,412,381 A 5/1995 Dicks
5,419,065 A * 5/1995 Lin
5,452,963 A 9/1995 Christensen
5,460,353 A 10/1995 Rittenhouse
5,467,548 A 11/1995 Ross
5,498,101 A 3/1996 Braverman
5,586,594 A 12/1996 Shapoff
5,605,413 A 2/1997 Brown
5,609,327 A * 3/1997 Amidon ..... 256/24
5,611,641 A 3/1997 Christensen
5,634,225 A 6/1997 Miller, Sr. et al.
5,639,179 A 6/1997 Jensen
5,697,180 A * 12/1997 Morizio
5,772,357 A 6/1998 Evans
5,775,919 A 7/1998 Gardner
5,836,714 A 11/1998 Christensen
5,863,030 A 1/1999 Kotler et al.
5,882,140 A 3/1999 Yodock, Jr. et al.
5,921,696 A * 7/1999 Gillotti
5,941,002 A * 8/1999 Rusin
5,993,103 A 11/1999 Christensen
6,190,084 B1 * 2/2001 Ibanez ..... 160/351 X
6,199,833 B1 * 3/2001 Bilby et al. ..... 256/24
6,257,559 B1 * 7/2001 Mouri

* cited by examiner

CONTROL BARRIER WITH ROTATABLE LEGS

CROSS-REFERENCE TO RELATED APPLICATIONS

This application is a continuation-in-part of Ser. No. 09/577,404, filed May 22, 2000 now abandoned, which is a continuation-in-part of Ser. No. 08/974,001, filed Nov. 19, 1997, U.S. Pat. No. 6,086,285, which is a continuation-in-part of Ser. No. 08/841,467, filed Apr. 22, 1997, U.S. Pat. No. 5,993,103, which are hereby incorporated by reference.

BACKGROUND OF THE INVENTION

1. The Field of the Invention

The present invention relates to barriers, and more particularly, portable, reusable, control barrier systems having rotatable support legs.

2. The Relevant Technology

Control barriers are used in a variety of situations. For example, control barriers can be selectively positioned at special events, such as parades, to help direct crowds in a desired direction. Alternatively, control barriers can be put up to help limit access to select areas. In yet other embodiments, control barriers can be used to define an area such as an entertainment stage or the course for a sporting event.

Conventional control barriers have long comprised individual sawhorse type barriers and collapsible V-shape barricades. Such barriers, however, are generally lightweight and are easily tipped over. As a result, conventional control barriers have limited use in situations where crowds may be pushing against the barriers or where it is likely that the barriers may be impacted. In addition, such barriers are typically made of non-flexible metals or wood and have sharp corners. Accordingly, such structures pose a potential risk to crowds, athletes, or the like who may be pushed or otherwise come in contact with the barriers. Furthermore, such barriers are typically not connected and often have spaces or gaps extending therethrough. As such, it is possible for individuals to either slip between or through the barriers.

In one alternative embodiment, concrete barriers have been used. Although concrete barriers are not easily tipped over, such barriers are extremely heavy. As such, they are difficult to move and place in a desired location. Often, special equipment such as fork lifts or cranes are required. Furthermore, concrete barriers require a large storage area, are difficult and expensive to move over large distances, and are difficult to dispose of once they are damaged or begin to fail. Finally, concrete barriers can be dangerous in that they are rigid and non-forgiving when impacted by a person or object.

Other barriers comprise various gate or wall configurations. Such barriers, however, require extensive time to assemble and disassemble. Most gate or wall configurations have integral legs to provide stability. These configurations are typically cumbersome and bulky and not easily stackable. Conventional wall barriers must be stored in an upright position, thus requiring a large amount of space. Furthermore, when such barriers are stacked, it becomes easy for one of the barriers to fall from the stack, thus posing a danger to the people working with the barriers and to innocent passersby. A crowd control barrier can easily weigh between 25 and 75 pounds. Thus, it would be an improvement in the art to have a crowd control barrier which is easily assembled and disassembled and, when storage, takes up a minimal amount of space.

BRIEF SUMMARY OF THE INVENTION

The present invention provides in one embodiment a collapsible control barrier including a barrier wall, a first support assembly and a second support assembly. The barrier wall has wind ports to prevent wind resistance. A display recess is provided upon which may be mounted an advertising display. The barrier wall comprises a set of tenons and mortises providing mating surfaces with which to stack a number of control barriers. The barrier wall also has a set of connectable arms comprising either pins or ports to allow a series of control barriers to be connected together.

The support assemblies allow the control barrier to be collapsed from a support position to a standing position and vice versa. In one embodiment, the support assemblies comprise a leg having an upper section and a lower section. The upper and lower sections are positionable in relation to each other by a spring clip assembly. In another embodiment, a through-pin assembly is provided so that the upper section and lower section can be positioned with respect to each other. In yet another embodiment, a cam buckle assembly is provided to position upper section and lower section in relation to each other. In still another embodiment, a threaded assembly may be used to rotate and extend the upper section with respect to the lower section.

The support assemblies also comprise a foot attached to the leg. The foot is preferably elongated. The foot is positionable between a stored position and a support position. When in the stored position, the foot is flush with the barrier wall. When in the support position, the foot is angled with respect to the barrier wall. It will be understood that the leg may be extended and/or rotated to position the foot in the desired position. Other embodiments are described herein which provide that the support assembly comprises only a foot which is rotatable between a stored position and a support position.

It will be appreciated from the foregoing and from the following description that the present invention provides a control barrier which is easily assembled and disassembled and which provides for control barriers according to the present invention to be easily stacked and stored. These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
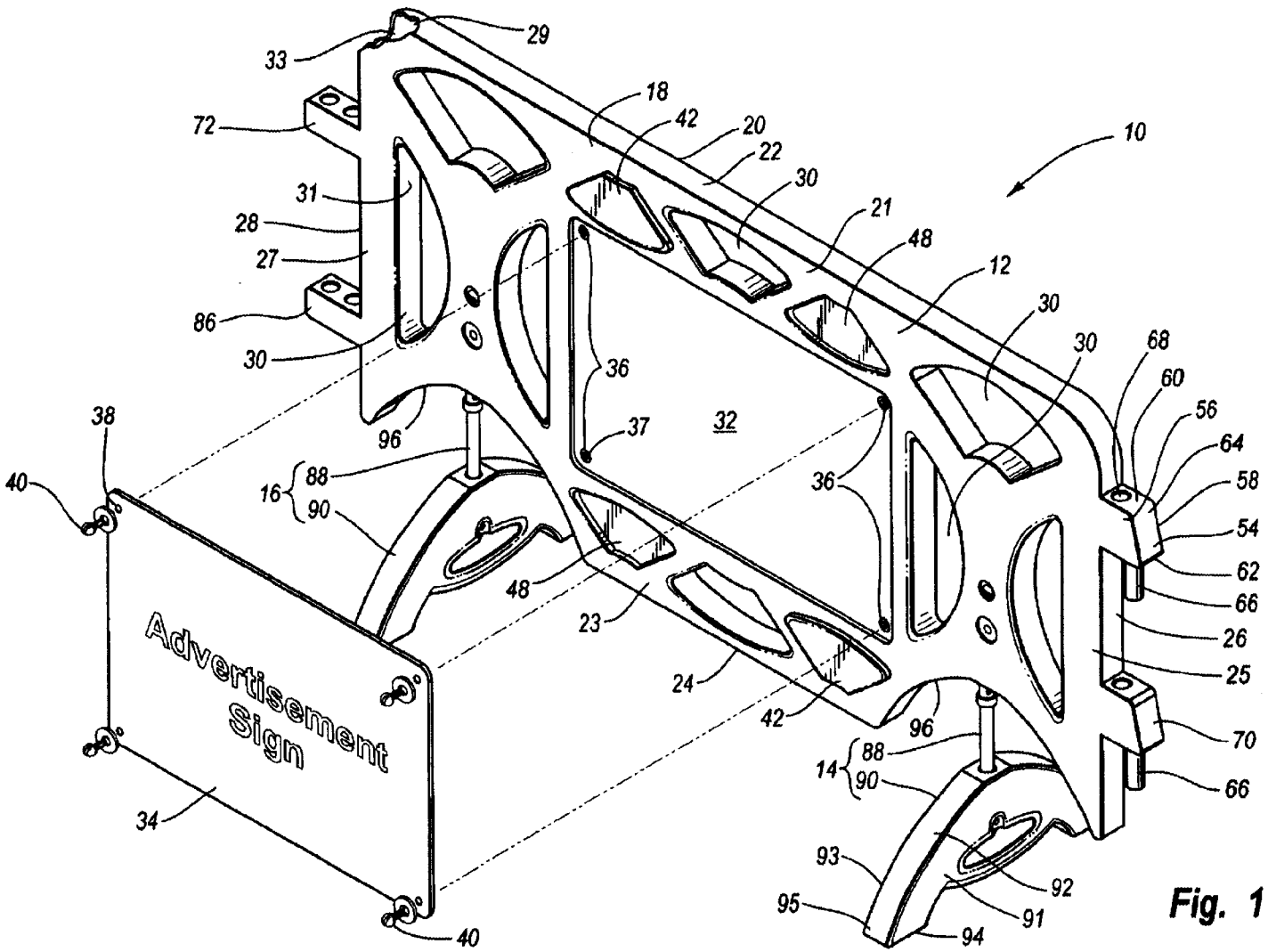
FIG. 1 is a front perspective view of one embodiment of a control barrier in a support position.
Figure 2:
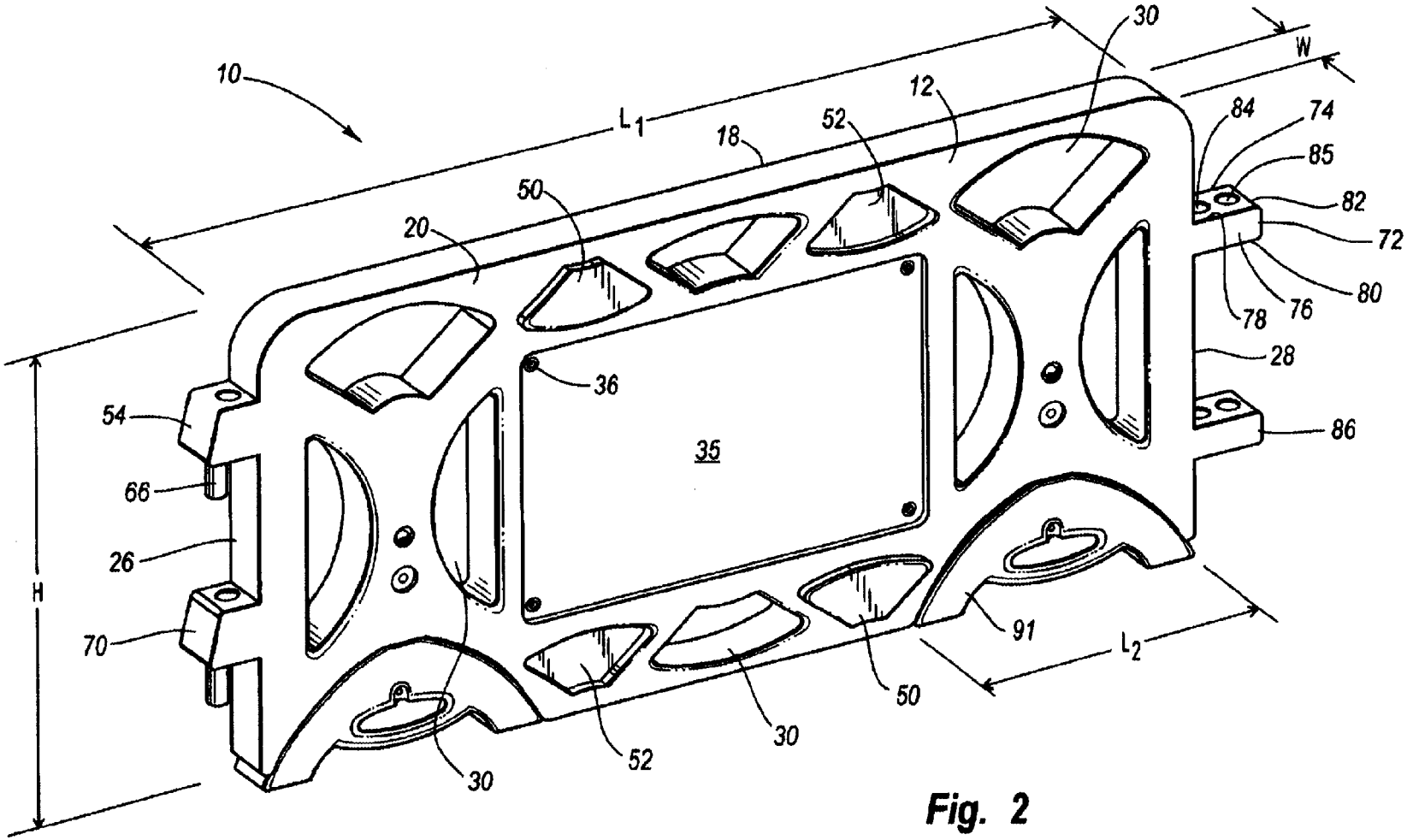
FIG. 2 is a back perspective view of the control barrier shown in FIG. 1 in a storage position.

Depicted in FIGS. 1 and 2 is one embodiment of an inventive control barrier 10 incorporating features of the present invention. Control barrier 10 comprises a barrier wall 12 having a first support assembly 14 and an opposing second support assembly 16 attached thereto. One feature of the present invention is that support assemblies 14, 16 may be collapsible between a support position (FIG. 1) and a storage position (FIG. 2) as will be described in further detail below. Barrier wall 12 has a thin, substantially box shaped configuration that includes a front face 18 with an opposing back face 20. Faces 18 and 20 are substantially flat and have a substantially rectangular configuration.

Barrier wall 12 also includes a top end 21 having a top surface 22 located thereat and an opposing bottom end 23 with a bottom surface 24 located thereat. A first sidewall 26 is located at a first side 25 of barrier wall 12 while a second sidewall 28 is located at an opposing second side 27. Although front face 18, back face 20, top surface 22, bottom surface 24, and sidewalls 26, 28 are shown as being either vertically or horizontally disposed, each of these can also be selectively sloped at a desired angle.

Barrier wall 12 typically has a height H in a range between about 30 inches to about 54 inches with about 36 inches to about 48 inches being more preferred; a length $L_1$ in a range between about 72 inches to about 120 inches with about 90 inches to about 102 inches being more preferred; and a width W extending between front face 18 and back face 20 in a range between about 1 inch to about 7 inches with about 2 inches to about 4 inches being more preferred.

In one embodiment, barrier wall 12 has an interior surface 29 bounding a chamber 33. If desired, means can be provided for selectively filling the chamber 33 with a ballast such as sand or water. Suitable means may include a fill hole (not shown) formed on top surface 22 of barrier wall 12 so as to communicate with the chamber 33. A corresponding draining hole with cap or plug (not shown) may be formed on the bottom surface 24 of barrier wall 12. In another embodiment, barrier wall 12 can also be solid.

In one embodiment of the present invention, means are provided for selectively securing an advertising display 34 substantially flush against front face 18 of barrier wall 12. By way of example and not by limitation, depicted in FIG. 1 is a display recess 32 formed on front face 18. Display recess 32 is shown having a substantially rectangular configuration. In alternative embodiments, display recess 32 can have other geometrical configurations such as circular, triangular, or square. FIG. 1 shows display 34 shaped to be received into display recess 32. Display 34 may be made of paper, plastic, cardboard, or the like that is sized so as to fit within display recess 32. In one embodiment, display recess 32 is sufficiently deep such that when display 34 is received therein, the front face of display 34 is substantially flush with the surface of front face 18. This helps to prevent people standing adjacent to control barrier 10 from catching an edge of display 34.

Secured within each corner of display recess 32 is an insert 36 having a threaded hole 37. Display 34 is secured to barrier wall 12 by passing bolts 40 through apertures 38 in display 34 and then threading the bolts 40 within holes 37 of corresponding inserts 36. As depicted in FIG. 2, a similar display recess 35 and corresponding structure for attaching a display therein can also be formed on back face 20 of barrier 12. Different structures may be used to perform the same function as inserts 36 and bolts 40 shown in FIG. 1. For example, pin assemblies, rivets, clips, adhesive, and the like can be used. Furthermore, barrier wall 12 may also provide retention lips and a transparent cover to assist in securing display 34 within display recess 32. Such embodiments are described in U.S. Pat. No. 5,993,103 which is incorporated herein by specific reference.

There are several benefits to using the above structure for attaching advertising display 34 to barrier wall 12. Most notably, by attaching display 34 flush against the surface of barrier wall 12, projecting comers and edges are eliminated. As such control barriers 10 can be used in sporting events and for directing crowds while minimizing the potential injury to an individual who may impact the control barriers. Furthermore, the above structure provides easy attachment and removal of display 34 and provides for prominent disclosure of the advertising display As also depicted in FIGS. 1 and 2, a plurality of wind ports 30 extend through barrier wall 12 between front face 18 and back face 20. Each wind port 30 is bounded by an encircling interior wall 31. In the embodiment depicted, wind ports 30 are located around the perimeter of display recesses 32 and 35. In alternative embodiments, wind ports 30 can also extend through the one or more display recesses or, when the display recesses are not formed, in the location thereof. Wind ports 30 are provided to allow air to freely pass through barrier wall 12 so that control barrier 10 does not tip over from wind pressure. Barrier wall 12 may have more or fewer wind ports 30 depending on the particular application. In some embodiments, wind ports 30 may not be present. Furthermore, wind ports 30 may be formed in any number of aesthetically pleasing shapes or configurations.

The present invention also includes means for mechanically mating a pair of barriers together such that a number of discrete control barriers can be stacked in a substantially flat interlocking configuration. By way of example and not by limitation, FIG. 1 shows a plurality of tenons 42 projecting from front face 18 and a plurality of mortises 48 recessed within front face 18. Similarly, depicted in FIG. 2, a plurality of tenons 50 project from back face 20 and a plurality of mortises 52 are recessed within back face 20.

Figure 3:
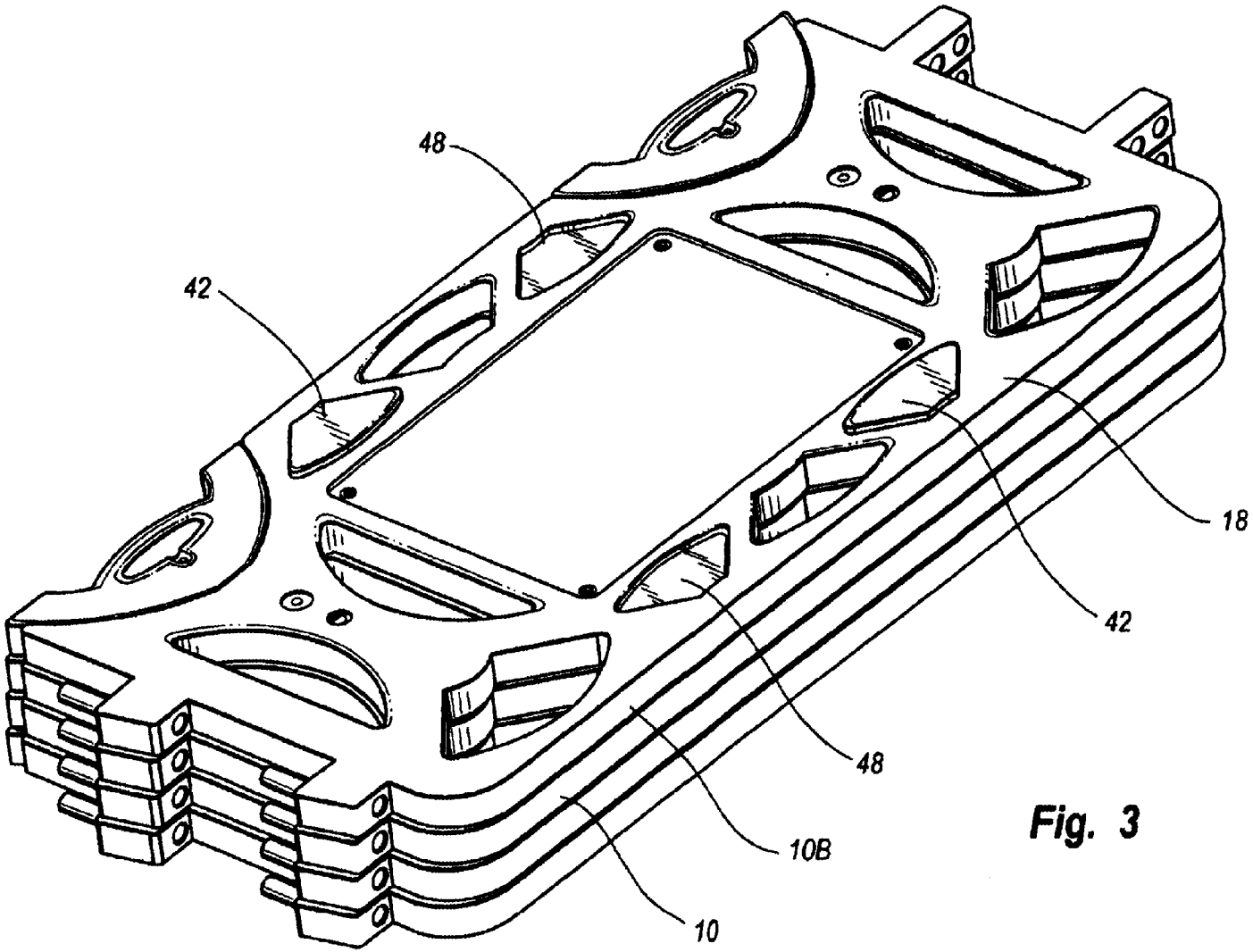
FIG. 3 is a perspective view of four control barriers stacked in a storage position.

As apparent from FIGS. 1–3, tenons 42 on front face 18 of control barrier 10 are configured to complementary mate within mortises 52 on back face 20 of a control barrier 10A (control barrier 10A having the same configuration as control barrier 10) when control barrier 10A is stacked on top of control barrier 10. In this configuration, tenons 50 on back face 20 of control barrier 10A also mate within mortises 48 on front face 18 of control barrier 10. As a result of the mating between the mortises and the tenons, a plurality of control barriers can be easily stacked in a close, compact and substantially flat configuration wherein the barriers are interlocked so as to prevent one or more barriers from accidentally sliding off of another barrier. As such, control barriers 10 are mated together and the resulting mated control barriers have a substantially box shaped configuration. This is particularly important as the height of the stacked barriers increases. Advantageously, the mated control barriers 10 are easily stacked for transport and/or storage.

Although not required, the tenons preferably have a configuration complementary to the mortises so that they couple in relatively close tolerance. In the embodiment depicted, barrier wall 12 has two tenons and two mortises on each of front face 18 and back face 20. In alternative embodiments, front face 18 and 20 can each comprise more or fewer tenons and mortises. Furthermore, front face 18 may comprise only tenons while back face 20 may comprise only mortises. The tenons and mortises shown in FIGS. 1 and 2 have a shell-shaped configuration. In alternative embodiments, tenons and mortises can have a variety of alternative configurations and need only be constructed so that they mate together. In this manner, control barrier 10 is provided with a clean, simplistic appearance and yet obtains the benefit of a stacking feature.

The present invention also includes means for interconnecting adjacent control barriers 10. By way of example and not by limitation, FIG. 1 shows a first retention arm 54 projecting from the sidewall 26 of barrier wall 12. First retention arm 54 has a front face 56 and a back face 58 preferably flush with front face 18 and back face 20, respectively, of barrier wall 12. First retention arm 54 also has a top surface 60, bottom surface 62 and one exposed sidewall 64. Extending from the bottom surface 62 is a pin 66. Pin 66 is preferably spaced apart from sidewall 26 so as to allow room for maneuvering control barrier 10 when it is connected to another control barrier 10.

First retention arm 54 can also be configured to have a port 68 partially or completely extending through first retention arm 54 from top surface 60 to bottom surface 62. As discussed below in greater detail, port 68 is configured to receive pin 66 of another barrier. Preferably, port 68 is spaced apart from pin 66 so that they are not in vertical alignment. It will be understood that while pin 66 is shown nearest sidewall 64 and port 68 is shown near sidewall 26, those skilled in the art will recognize that pin 66 and port 68 can be switched in relative position.

A second retention arm 70 extends from first sidewall 26 of barrier wall 12 at a position below first retention arm 54. Second retention arm 70 has substantially the same configuration and performs substantially the same function as first retention arm 54. Thus, for ease of reference, like structural elements between first retention arm 54 and second retention arm 70 are identified herein by like reference characters.

A first receiving arm 72 extends from second sidewall 28 of barrier wall 12. With reference to FIG. 2, first receiving arm 72 has a front face 74 and back face 76 preferably flush with front face 18 and back face 20, respectively, of barrier wall 12. First receiving arm 72 also has a top surface 78, bottom surface 80, and an exposed sidewall 82. First receiving arm 72 is shown having an inside port 84 and an outside port 85 each extending partially or completely through first receiving arm 72 from top surface 78 to bottom surface 80. Ports 84 and 85 are configured to receive a pin 66 of another control barrier 10.

A second receiving arm 86 is shown extending from the second sidewall 28 of barrier wall 12 at a position below first receiving arm 72. Second receiving arm 86 has substantially the same configuration and performs substantially the same function as first receiving arm 72. Thus, for ease of reference, like structural elements between first receiving arm 72 and second receiving arm 86 are identified herein by like reference characters. While first receiving arm 72 shows two ports 84 and 85, it will be recognized that first receiving arm 72 and second receiving arm 86 are not limited to this particular configuration. In one embodiment, the receiving arms may have one or three or more ports. In another embodiment, the receiving arms may have one port and one pin similar to first retention arm 54.

Figure 4:
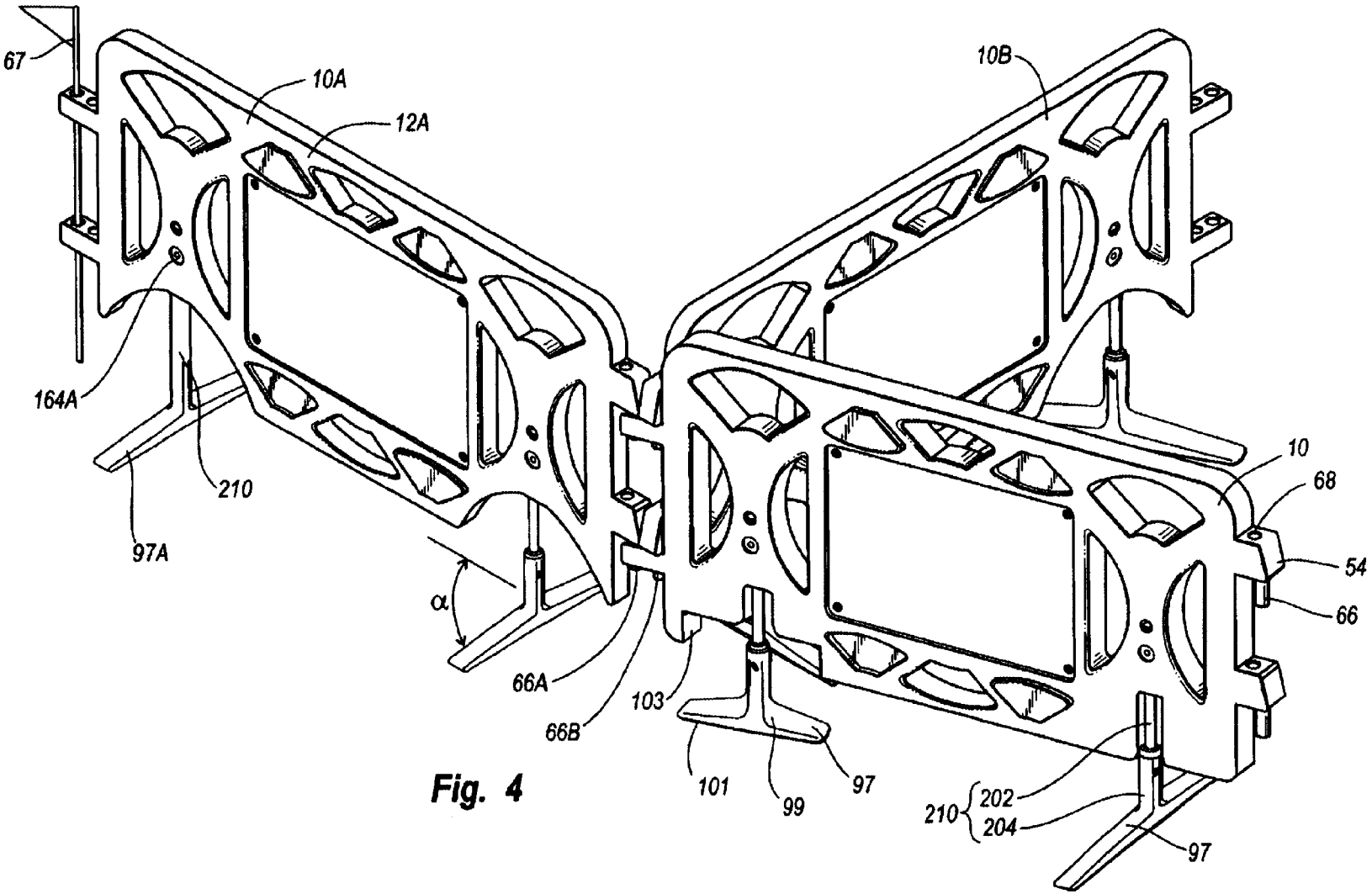
FIG. 4 is a perspective view of three control barriers connected together in a support position.

The foregoing configuration of pins and ports advantageously allows a user to couple one control barrier 10 with an adjacent control barriers having substantially the same configuration. As shown in FIG. 4, three control barriers 10, 10A, 10B are shown connected together in a T-shape configuration. Because control barriers 10, 10A, 10B are substantially the same, for ease of reference, like structural elements will be identified herein with similar reference characters. Pins 66A of control barrier 10A are received outside ports 85 of control barrier 10 to effectively connect control barriers 10 and 10A together. This pin coupling acts as a hinge to allow control barriers 10 and 10A to be angled in any desired orientation relative to each other. Pins 66B of barrier 10B are similarly coupled inside ports 84 of control barrier 10. In this configuration, three control barriers can be used to form a Y-shape, T-shape or a variety of other interconnected configurations which separate discrete areas.

If desired, discrete control barriers can also be coupled with ports 68 and pins 84 of retention arms 54 and 70 of control barrier 10. The various ports 68, 84, and/or 85 can also be used to receive a pole 67, such as a flag pole, or any other form of rod or shaft. Those skilled in the art will recognize that control barrier 10 is not limited to a certain number of retention arms or receiving arms, but that more or fewer retention arms or receiving arms may be implemented.

In an alternative embodiment, it is also appreciated that pins 66 can upwardly project from top surface 60 of the retention arms. In this embodiment, the pins 66 would upwardly extend into the ports on the receiving arms.

Turning now to another aspect of the present invention, FIG. 1 shows two support assemblies 14, 16 attached to barrier wall 12. By way of example and not by limitation, FIG. 1 shows support assembly 14 comprising a leg 88 and a foot 90. Foot 90 is shown having a substantially arcuate configuration with a front face 91, a back face 93, and a side wall 95 extending therebetween. Sidewall 95 includes a rounded top portion 92 and a substantially flat bottom portion 94.

Foot 90 has a length $L_2$ that is long enough so that support assembly 14 can maintain barrier wall 12 in a stable standing position. Length $L_2$ is typically within a range between about 12 inches to about 48 inches with about 20 inches to about 30 inches being more preferred. The width of foot 90 corresponds to the width W of barrier wall 12 so that when foot 90 is in a storage position, as shown in FIG. 2, front face 91 and back face 93 are preferably flush with front face 18 and back face 20, respectively, of barrier wall 12. If desired, a rubberized pad can be mounted on bottom portion 94 to minimize sliding of control barrier 10.

Barrier wall 12 is shown in FIG. 1 as having pair of spaced apart curved recesses 96 formed on bottom surface 12. Each recess 96 is configured complementary to rounded top portion 92 of each foot 90. Accordingly, as depicted in FIG. 2, each foot 90 can be received within a corresponding recess 96 so that flat bottom portion 94 of each foot 90 is substantially flush with bottom surface 24 of barrier wall 12. Although foot 90 is shown to have an arcuate configuration in FIGS. 1 and 2, foot 90 may be configured in a variety of polygonal or other shapes. Furthermore, recesses 96 can be configured to have a complementary configuration of the foot. For example, as shown in FIG. 4, an elongated foot 97 is shown having a substantially flat top surface 99 and a substantially flat bottom surface 101. A shallow rectangular recess 103 is configured to receive foot 97 when in the storage position.

As depicted in FIGS. 1 and 2, barrier wall 12 is disposed within a first plane. In one embodiment of the present invention, means are provided for selectively moving foot 90 between a storage position, as shown in FIG. 2, wherein foot 90 is disposed within the first plane and a support position, as shown in FIG. 1, wherein foot 90 is disposed within a second plane that intersects with the first plane at an angle. In the support position, at least a portion of foot 90 projects beyond front face 18 of barrier wall 12 and back face 20 barrier wall 12.

Figure 5:
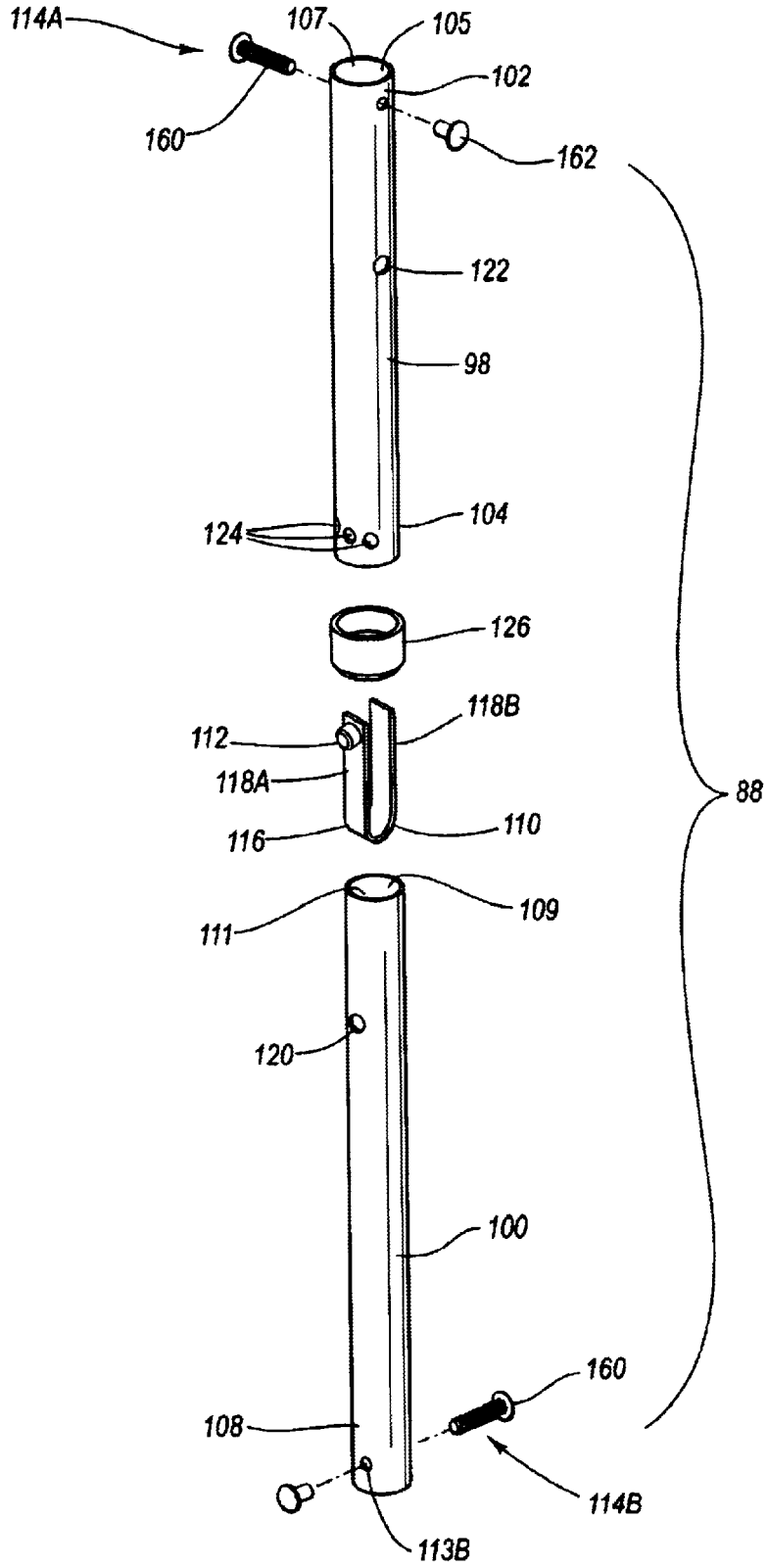
FIG. 5 is an exploded view of a leg of the control barrier shown in FIG. 1.

By way of example of the means and not by limitation, depicted in FIG. 5 is leg 88 comprising an upper leg portion 98 and a lower leg portion 100. Upper leg portion 98 comprises a tubular shaft having a first end 102 and an opposing second end 104. Upper leg portion 98 has an interior surface 105 that bounds a first channel 107 longitudinally extending therethrough. An attachment bore 113A transversely extends through upper leg portion 98 at first end 102. A plurality of radially spaced apart extension ports 124 are formed at second end 104. Positioned between ends 102 and 104 is a retraction port 122. Retraction port 122 and extension ports 124 are typically offset at angles ranging from 0° to 180°.

Figure 6A:
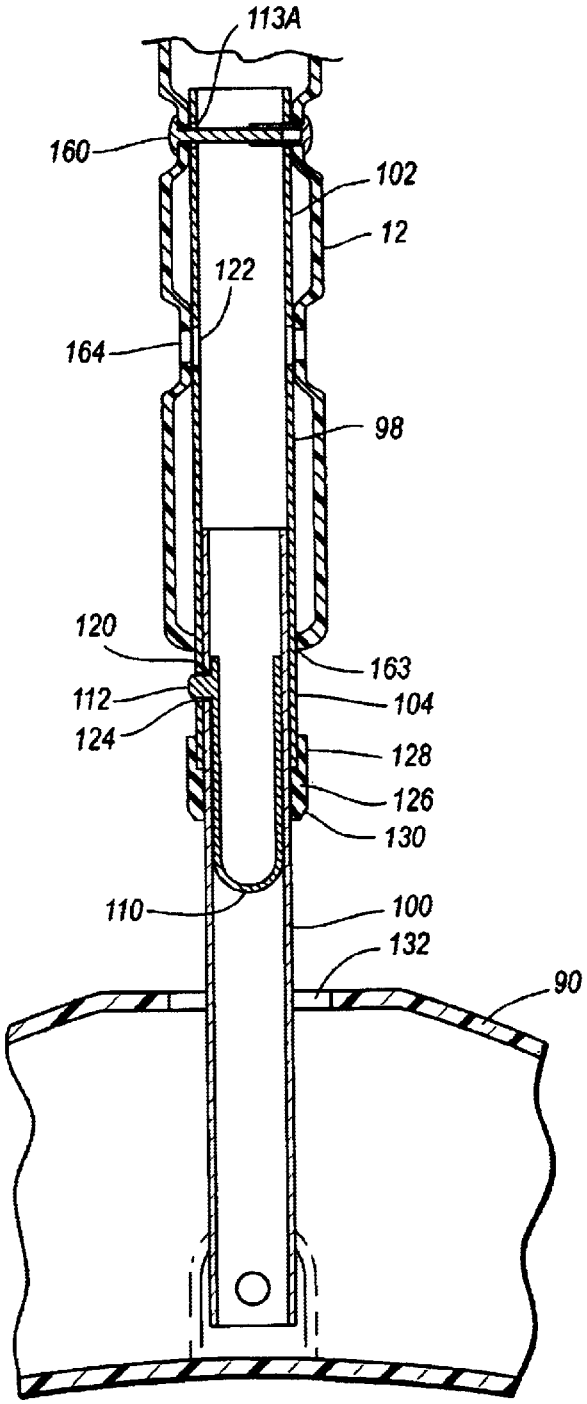
FIG. 6A is a cross-sectional side view of the leg of the control barrier as shown in FIG. 1 in a support position.

As depicted in FIG. 6A, upper leg 98 portion is secured to barrier wall 12 by inserting first end 102 through an opening 163 formed on curved recess 96 of bottom surface 24 of barrier wall 12. An attachment assembly 114A comprises a bolt 160 and a threaded cap 162. Bolt 160 is passed through barrier wall 12 and attachment bore 113A and is then held in place by engagement with cap 162. Upper leg portion 98 can also be secured to barrier wall 12 by wedged or press fit connection or by riveting, welding, brasing, adhesive, and the like. In this position, retraction port 122 is aligned with a opening 164 formed on barrier wall 12 while second end 104 and extension ports 124 extend below barrier wall 12.

Returning to FIG. 5, lower leg portion 100 comprises a tubular shaft having a first end 106 and an opposing second end 108. Lower leg portion 10 has an interior surface 109 that bounds a second channel 111 longitudinally extending therethrough. An attachment bore 113B transversely extends through lower leg portion 100 at second end 108. Positioned between ends 106 and 108 is a pin port 120. As discussed below in greater detail, lower leg portion 100 configured so that it can be freely slidably and rotatably moved within channel 107 of upper leg portion 98.

Figure 6B:
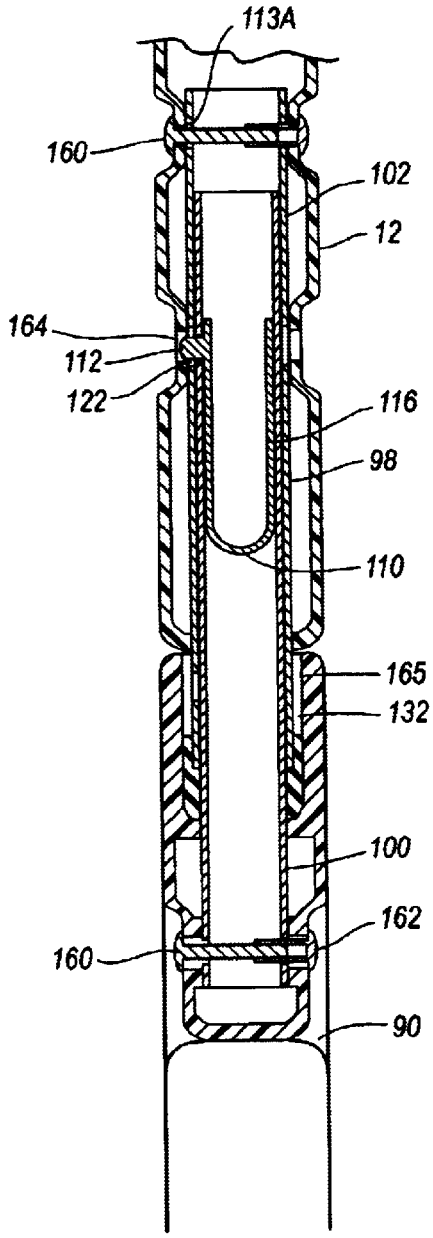
FIG. 6B is a cross-sectional side view of the leg of the control barrier of as shown in FIG. 2 in a storage position.

Depicted in FIG. 6B, lower leg portion 110 is secured to foot 90 by inserting second end 108 through an opening 165 centrally formed on rounded top portion 92 of foot 90. Bolt 160 from an attachment assembly 114B is then passed through foot 90 and attachment bore 113B and is then held in place by engagement with a cap 162. Lower leg portion 110 can also be secured to foot 90 using the same alternative methods as discussed above with regard to securing upper leg portion 98 to barrier wall 12.

As depicted in FIGS. 5 and 6, a spring pin 110 is disposed within channel 111 of lower leg portion 100. Spring pin 100 comprises a substantially U-shaped spring 116 having a first arm 118A and a second arm 118B. A pin 112 outwardly projects from first arm 118A. Spring pin 100 is disposed within channel 111 so that pin 112 passes through and beyond pin port 120. Second arm 118B is typically spot welded to inside surface 109 of lower leg portion 100 so as to prevent unwanted movement. In this configuration, pin 112 can be manually pushed into pin port 120 while spring 116 resiliently pushes pin 112 back through pin port 120 when released.

In the above configuration, first end 106 of lower leg portion 110 is slidably received within channel 107 of upper leg portion 98. In the storage position, as depicted in FIGS. 2 and 6B, lower leg portion 100 is advanced within upper leg portion 98 until pin 112 is aligned with retraction port 122. In this position, spring 116 biases pin 112 at least partially though retraction port 122, thereby securing leg portions 98 and 100 in the retracted storage position.

To facilitate movement into an extended support position, as shown in FIGS. 1 and 6A, pin 112 is manually inwardly pressed through opening 164. Lower leg portion 100 is then progressively advanced out of upper leg portion 98 and rotated until pin 112 is aligned with one of extension ports 124. Again spring 116 biases pin 112 at least partially though the select extension port 124, thereby securing leg portions 98 and 100 in the extended support position. Pin 112 is preferably rounded at the top to allow for ease of inserting pin 112 into ports 122 and 124. By rotating the pin 112 between different extension ports 124, foot 90 can be positioned at a desired angle relative to barrier wall 12. For example, by having multiple extension ports 124 an inside angle (such as angle $\alpha$ depicted in FIG. 4) between foot 90 and barrier wall 12 can be fixed at, for example, 30°, 45°, 70°, or 90°. The angle can also be set at greater than 90°.

In one embodiment as depicted in FIGS. 5 and 6A, a tubular collar 126, typically made of plastic or other soft material, is secured to second end 104 of upper leg portion 98. Collar 126 includes an upper section 128 that encircles upper leg portion 98 and a lower section 130 that extends below upper leg portion 98. Collar 126 is placed low enough to allow clearance for extension ports 124. Lower section 130 has an inner diameter that is substantially the same as the outer diameter of lower leg portion 100. Specifically, lower section 130 of collar 126 is configured to ride in a smooth frictional engagement against lower leg portion 100 as lower leg portion 100 is rotated and slid within upper leg portion 98. Collar 126 enables a slight tolerance between leg portions 98 and 100 while still allowing smooth frictional engagement between the two elements. As shown in FIGS. 6A and 6B, foot 90 has an annular recess 132 formed at opening 165 in which collar 126 is received when in the retracted storage position.

In one embodiment, it is appreciated that leg 88 need not be extended to be placed in the storage position. That is, lower leg portion 100 can simply be rotated when in the retracted position to place foot 90 in the support position. Furthermore, a plurality of extension ports 124 can also be placed at different positions along the length of upper leg portion 98 so that barrier wall 12 can be raised to different heights.

While FIG. 5 shows upper leg portion 98 as having a larger diameter than lower leg portion 100, it will be recognized that the opposite configuration may be effectively utilized as well. Furthermore, the configuration of leg portions 98 and 100 can be reversed so that pin spring 110 is secured within upper leg portion 98.

In one embodiment, it is appreciated that only a single support assembly is need to support barrier wall 12 in the support position. For example, with foot 90 or 97 in the retracted position, the lower leg portion 100 can be rotated so that the foot is in the support position. As a result of both the foot and the remainder of barrier wall 12 resting on the ground surface in intersecting planes, barrier wall 12 would be self-supporting. In this embodiment, the support assembly can be centrally location on barrier wall 12. In the depicted embodiment, however, second support assembly 16 is used in association with first support assembly 14. Second support assembly 16 has substantially the same configuration and performs substantially the same function as first support assembly 14. Thus, for ease of reference, like structural elements between first support assembly 14 and second support assembly 16 are identified herein by like reference characters. Preferably, support assemblies 14, 16 are equally spaced apart from the center of barrier wall 12.

Leg 88 can also have a variety of different configuration. For example, while upper section 98 and lower section 100 are shown in FIG. 5 having a cylindrical transverse configuration, they may also be formed in any complementary geometrical transverse configuration such as square or hexagonal. In this embodiment, rotation of the lower leg portion simply entails completely separating the two leg portions and then coupling them back together at the desired orientation.

Figure 7:
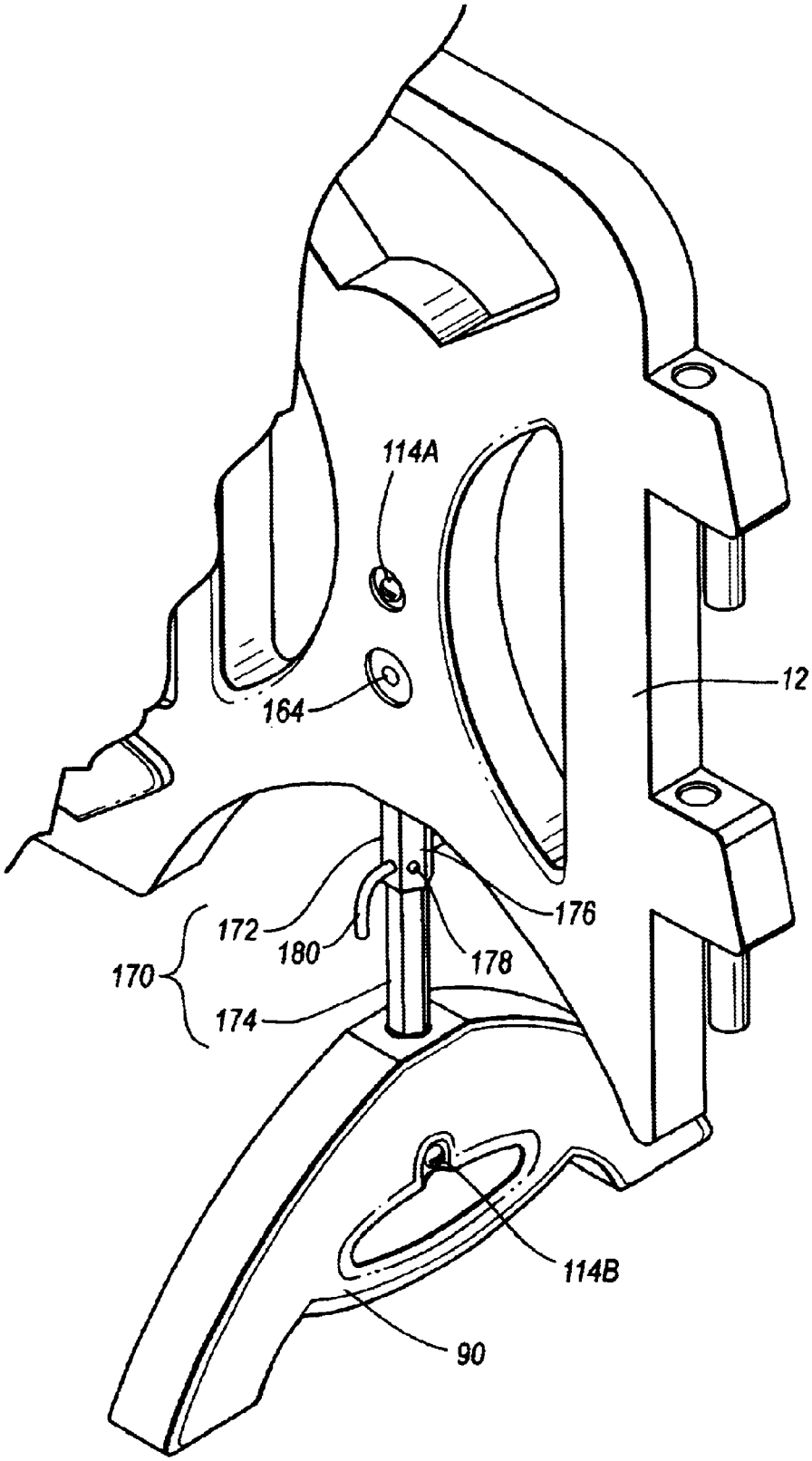
FIG. 7 is a partial perspective of an alternative embodiment of a leg of a control barrier having.

In one such example as depicted in FIG. 7, a leg 170 is shown coupling foot 90 to barrier wall 12. Leg 170 has an upper leg portion 172 and an lower leg portion 174 slidably received therein. Leg portions 172 and 174 each have a hexagonal transverse cross section and are attached to barrier wall 12 and foot 90 by attachment assemblies 114A and 114B as previously discussed. As with leg 88, upper leg portion 172 has a retraction port formed therein that is aligned with opening 164 on barrier wall 12. Upper leg portion 172 also has a lower end 176 having an extension port 178 formed on each face thereat. In contrast to using spring pin 110, leg portions 172 and 174 are secured together by passing a removable pin 180 through aligned ports.

Figure 8:
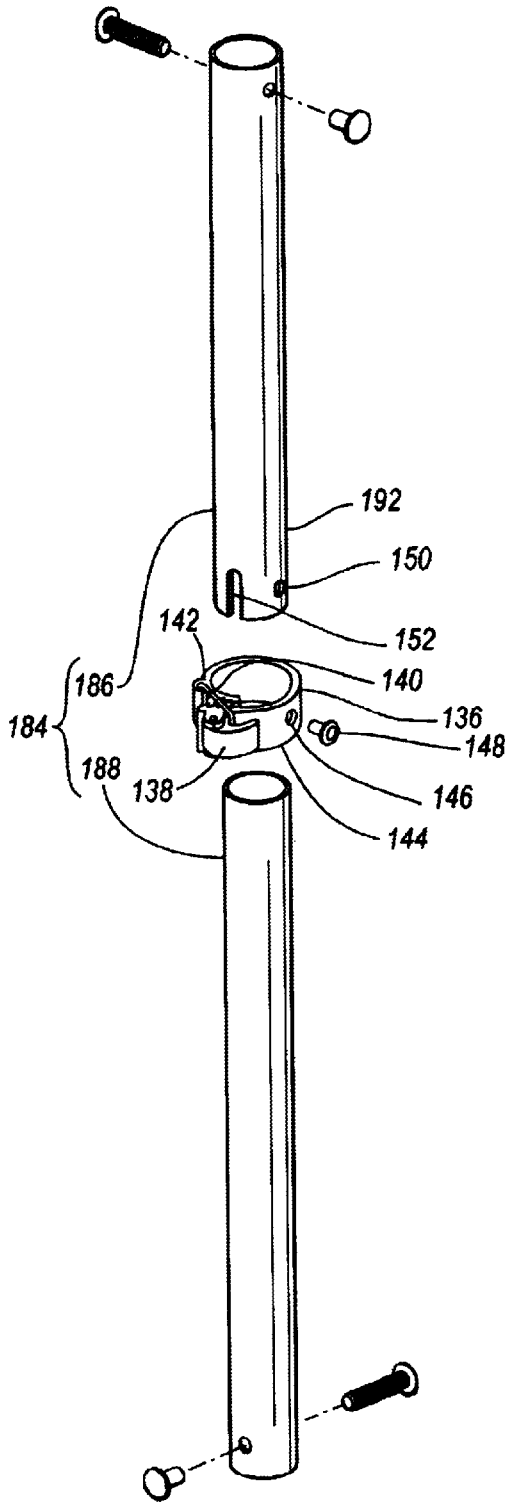
FIG. 8 is an exploded perspective view of an alternative embodiment of a leg of a control barrier having a cam buckle.

Depicted in FIG. 8 is another embodiment of a leg 184. Leg 184 includes an upper leg portion 186 and a lower leg portion 188. Upper leg portion 186 is hollow and configured to receive lower leg portion 188. Leg portions 186 and 188 are secured to barrier wall 12 and foot 90 in substantially the same way as discussed above with regard to leg 88. Lower end 192 of upper leg portion 186 has a slot 152 so that leg portion 186 can be constricted thereat. In contrast to using pins and ports to secure leg portions 186 and 188 together, however, a cam buckle 192 is secured to a lower end 192 of upper leg portion 186 and utilizes friction force to hold leg portions 186 and 184 together.

Cam buckle 190 is in the shape of a circular collar having a first end 142 and a second end 144. A lever 138 is pivotally attached to the second end 144 of buckle 136. Buckle 136 also has a latch 140 attached to first end 142 of the buckle through which passes lever 138. Buckle 136 has a bore 146 which corresponds to a bore 150 located at lower end 192 of upper leg portion 186. Pin 148 is provided to secure buckle 136 using bores 146 and 150.

Lever 138 is shaped having a cam portion which provides greater force as lever 138 is pressed. The cam portion also holds lever 138 locked in the closed position. By opening lever 138, leg portions 186 and 188 can be relatively moved between the extended and retracted position and can also be relatively rotated between the storage and support position. When in the desired position, lever 138 is selectively closed so that leg portions 186 and 188 are locked in the desired position.

Figure 9:
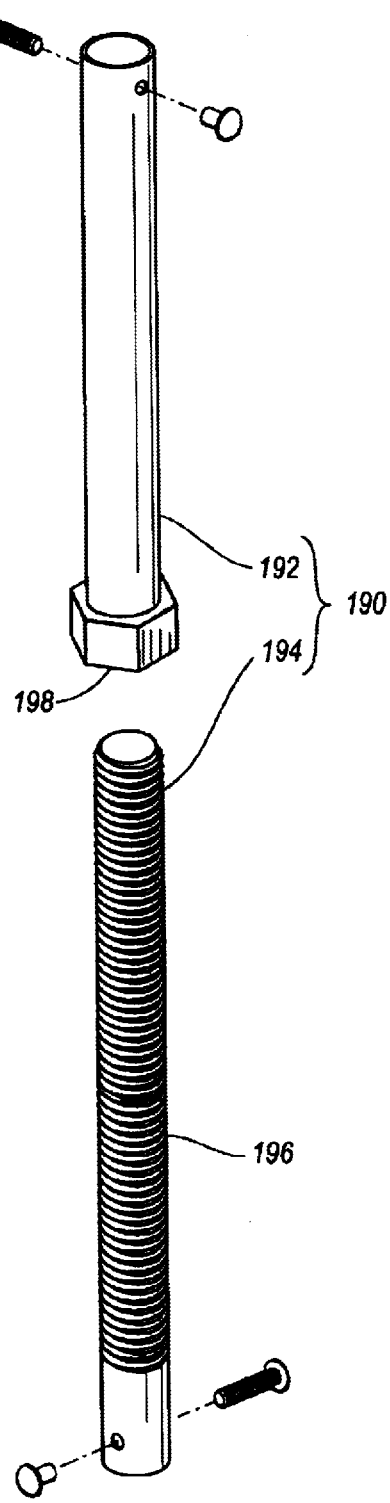
FIG. 9 is an exploded perspective view of another alternative embodiment of a leg of a control barrier having a threaded attachment.

Depicted in FIG. 9 is another embodiment of a leg 190. Leg 190 includes an upper leg portion 192 and a lower leg portion 194. Upper leg portion 192 is hollow and configured to receive lower leg portion 194. Leg portions 192 and 194 are secured to barrier wall 12 and foot 90 in substantially the same way as discussed above with regard to leg 88. Threads 196 are formed along a majority of the length of lower leg portion 194. Upper leg portion 192 bounds a threaded channel 198 that is configured threadedly engage with lower leg portion 194. The foregoing threaded assembly allows upper leg portion 192 and lower leg portion 194 to be rotated with respect to each other while remaining fixed with respect to each other. Further, the threaded engagement allows leg 190 to be selectively extended and contracted.

The foregoing examples depicted in FIGS. 5-8 are provided to illustrate alternative leg configurations and means for selectively locking the lower leg portion relative to the upper leg portion when in the collapsed storage position and in the longitudinally extended support position. The examples presented in this description show that rotational, frictional, and slidable configurations can all be used to position leg 88 in a storage position and a support position. Those skilled in the art will understand that spring pins, straight pins, cam buckles, and threaded assemblies are presented by way of example and not by limitation.

The present invention also envisions other leg embodiments which can be independently used or incorporated into one or more of the above embodiments. For example, depicted in FIG. 4 is one embodiment of a leg 200 which includes an upper leg portion 202 and a lower leg portion 204. In this embodiment, lower leg portion 204 is integrally formed with foot 97.

In another embodiment depicted in FIG. 4, a leg 210 is depicted extending between barrier wall 12A and foot 97A. In this embodiment, leg 210 is a single structure that is integrally formed with foot 97A. Leg 210 slidably extends into and is rotatable within barrier wall 12A. Various pin configuration, such as those disclosed above, can be used to secure leg 210 and barrier wall 12A together. For example, a pin can extend through opening 164A on barrier wall 12A and into leg 210. Similar to this embodiment, it is also appreciated that each of the upper leg portions disclosed in the above embodiments can be integrally formed as a portion of barrier wall 12.

In one embodiment, barrier wall 12 and each foot 90 are discretely made from plastic by a rotational molding process. Alternatively, other molding processes, such as injection molding, can also be used to manufacture the parts. The plastic use is preferably a resiliently deformable plastic material having strong, semi-rigid and energy absorbing properties. Such materials include linear or cross link plastics. Examples of conventional plastics include polyethylene, polyvinylchloride, nylon, polycarbonate, and polypropylene. Additives such as dyes, pigments, and reinforcements, such as fibers, can also be added to the material. Florescent dies can also be added to help control barriers 10 glow at night for better direction of traffic. The material can also be selected to enable old or broken barriers to be ground down and recycled into new barriers. It is also appreciated that barrier wall 12 can be made from wood, metal, composites, or any other desired material. The various legs are typically made of metal, such as aluminum, but can also be made of plastic and other materials.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A control barrier comprising:

a barrier wall comprising a front face and an opposing back face each extending between a top end and an opposing bottom end, the barrier wall being disposed in a first plane;

an upper leg portion having a first end disposed within the barrier wall and an opposing second end freely extending from the barrier wall, the upper leg portion bounding a first hole transversely extending into the upper leg at the first end and a second hole transversely extending into the upper leg portion at the second end;

an opening formed on the baffler wall so as to openly expose the first hole transversely extending into the upper leg;

a lower leg portion having a first end and an opposing second end, the first end of the lower leg portion being slideably coupled with the upper leg portion so as to enable selective extension of the second end of the lower leg portion away from the baffler wall;

a third hole being formed on the lower leg portion, the third hole being selectively alignable with the first hole and the second hole; and a first foot attached to the second end of the lower leg portion, the first foot being movable between a storage position wherein the first foot is disposed within the first plane and a support position wherein the first foot is disposed within a second plane that intersects with the first plane at an angle.

2. The control barrier as recited in claim 1, wherein the lower leg portion is integrally formed with the first foot.

3. The control barrier as recited in claim 1, wherein the upper leg portion and the lower leg portion are threadedly coupled together.

4. The control barrier as recited in claim 1, further comprising:

a second leg having a first end and an opposing second end, the first end of the second leg being attached to the bottom end of the barrier wall; and a second foot attached to the second end of the second leg, the second foot being movable between a storage position wherein the second foot is disposed within the first plane and a support position wherein the second foot is disposed within a third plane that intersects with the first plane at an angle.

5. The control barrier as recited in claim 1, further comprising a plurality of wind ports extending through the barrier wall between the front face and the back face.

6. The A control barrier as recited in claim 1, further comprising:

a tenon projecting from the front face of the barrier wall; and a mortis recessed within the back face of the baffler wall, the mortis having a configuration complementary to the tenon.

7. A control baffler comprising:

an upstanding baffler wall comprising a front face and an opposing back face each extending between a top end and an opposing bottom end, the front face and back face at least partially bounding a hollow chamber, the baffler wall being disposed in a first plane;

an elongated first foot;

a first leg comprising:

an upper leg portion having a first end and an opposing second end, at least a portion of the first end of the upper leg portion being disposed and secured within the hollow chamber of the baffler wall, the second end of the upper leg portion projecting from the bottom end of the baffler wall; and a lower leg portion having the elongated first foot mounted thereon, the lower leg portion being movably coupled with the upper leg portion so as to enable the lower leg portion to selectively longitudinally and rotationally move relative to the upper leg portion between a collapsed storage position and a longitudinally extended support position, the first foot being disposed in the first plane of the barrier wall when in collapsed storage position and being in a second plane disposed at an angle relative to the first plane when in the support position; and means for selectively locking the lower leg portion relative to the upper leg portion when in the collapsed storage position and in the longitudinally extended support position.

8. The control barrier as recited in claim 7, wherein the means for selectively locking comprises:

the upper leg portion bounding a first hole and a longitudinally spaced apart second hole, the first hole and the second hole each transversely extending into the upper leg; and a lower leg portion having a third hole formed thereon, the lower leg portion being movably coupled with the upper leg portion so as to enable selective alignment of the third hole with the first hole and the second hole.

9. The control barrier as recited in claim 7, wherein the means for selectively locking comprises:

the upper leg portion bounding a first hole and a longitudinally spaced apart second hole, the first hole and the second hole each transversely extending into the upper leg; and a lower leg portion having a pin mounted thereon, the lower leg portion being movably coupled with the upper leg portion so as to enable selective alignment of the pin with the first hole and the second hole.

10. The control barrier as recited in claim 7, wherein the means for selectively locking comprises a cam buckle assembly disposed about the upper leg portion.

11. The control barrier as recited in claim 7, further comprising:

a second leg having a first end and an opposing second end, the first end of the second leg being attached to the bottom end of the barrier wall; and a second foot attached to the second end of the second leg.

12. The control barrier as recited in claim 7, further comprising a plurality of wind ports extending through the barrier wall between the front face and the back face.

13. The control barrier as recited in claim 7, further comprising:

a tenon projecting from the front face of the barrier wall; and a mortis recessed within the back face of the barrier wall, the mortis having a configuration complementary to the tenon.

14. The control barrier as recited in claim 7, wherein the lower leg portion is integrally formed with the first foot.

15. The control barrier as recited in claim 7, further comprising:

a display recess formed on the front face of the baffler wall; and a display removably mounted within the display recess.

16. The barrier system as recited in claim 7, further comprising:

the barrier wall further comprises a first side and an opposing second side;

a first retention arm projecting from the first side of the barrier wall, the first retention arm having pin projecting therefrom; and a first receiving arm projecting from the second side of the barrier wall, the first receiving arm having a pair of spaced apart ports formed thereon, each port being configured to receive a pin from a first retention arm of another barrier.

17. A control barrier comprising:

a barrier wall comprising a front face and an opposing back face each extending between a top end and an opposing bottom end, the barrier wall being disposed in a first plane;

an upper leg portion having a first end and an opposing second, at least a portion of the upper leg portion being disposed within the baffler wall, the upper leg portion bounding a first hole and a longitudinally spaced apart second hole, the first hole and the second hole each transversely extending into the upper leg;

an opening formed on the baffler wall so as to openly expose the first hole transversely extending into the upper leg;

a lower leg portion having a third hole formed thereon, the lower leg portion being movably coupled with the upper leg portion so as to enable selective alignment of the third hole with the first hole and the second hole; and a first foot attached to the lower leg portion.

18. The barrier system as recited in claim 17, further comprising a spring pin at least partially projecting from the third hole.

19. The barrier system as recited in claim 17, further comprising a fourth hole formed on the lower leg portion, the forth hole being in horizontal alignment with the third hole.

20. The barrier system as recited in claim 17, wherein the first foot is movable between a storage position wherein the first foot is disposed within the first plane and a support position wherein the first foot is disposed within a second plane that intersects with the first plane at an angle.

21. The control barrier as recited in claim 17, further comprising:

a second leg having a first end and an opposing second end, the first end of the second leg being attached to the bottom end of the barrier wall; and a second foot attached to the second end of the second leg.

22. The control barrier as recited in claim 17, further comprising:

a tenon projecting from the front face of the barrier wall; and a mortis recessed within the back face of the barrier wall, the mortis having a configuration complementary to the tenon.

23. The control barrier as recited in claim 17, wherein the lower leg portion is integrally formed with the first foot.

24. The barrier system as recited in claim 17, further comprising:

the barrier wall further comprises a first side and an opposing second side;

a first retention arm projecting from the first side of the barrier wall, the first retention arm having pin projecting therefrom; and a first receiving arm projecting from the second side of the barrier wall, the first receiving arm having a pair of spaced apart ports formed thereon, each port being configured to receive a pin from a first retention arm of another barrier.

25. A control barrier comprising:

a barrier wall comprising a front face and an opposing back face each extending between a top end and an opposing bottom end, the barrier wall being disposed in a first plane;

an upper leg portion having a first end and an opposing second, at least a portion of the upper leg portion being disposed within the barrier wall, the upper leg portion bounding a first hole and a longitudinally spaced apart second hole, the first hole and the second hole each transversely extending into the upper leg;

an opening formed on the barrier wall so as to openly expose the first hole transversely extending into the upper leg;

a lower leg portion having a pin mounted thereon, the lower leg portion being movably coupled with the upper leg portion so as to enable selective alignment of the pin with the first hole and the second hole; and a first foot attached to the lower leg portion.

26. The barrier system as recited in claim 25, wherein the first foot is movable between a storage position wherein the first foot is disposed within the first plane and a support position wherein the first foot is disposed within a second plane that intersects with the first plane at an angle.

27. The control barrier as recited in claim 25, further comprising:

a second leg having a first end and an opposing second end, the first end of the second leg being attached to the bottom end of the barrier wall; and a second foot attached to the second end of the second leg.

28. The control barrier as recited in claim 25, further comprising:

a tenon projecting from the front face of the barrier wall; and a mortis recessed within the back face of the barrier wall, the mortis having a configuration complementary to the tenon.

29. The control baffler as recited in claim 25, wherein the lower leg portion is integrally formed with the first foot.

30. A barrier system as recited in claim 25, further comprising:

the barrier wall further comprises a first side and an opposing second side;

a first retention arm projecting from the first side of the barrier wall, the first retention arm having pin projecting therefrom; and a first receiving arm projecting from the second side of the barrier wall, the first receiving arm having a pair of spaced apart ports formed thereon, each port being configured to receive a pin from a first retention arm of another barrier.

* * * * *

UNITED STATES PATENT AND TRADEMARK OFFICE

CERTIFICATE OF CORRECTION

PATENT NO. : 6,676,113 B2
DATED : January 13, 2004
INVENTOR(S) : Christensen et al.

It is certified that error appears in the above-identified patent and that said Letters Patent is hereby corrected as shown below:

Column 2,
Line 6, change “provides” to -- provides, --
Line 6, change “embodiment” to -- embodiment, --

Column 3,
Line 8, after “barrier” change “of as” to -- as --
Line 10, change “barrier having;” to -- barrier; --

Column 4,
Line 28, change “comers” to -- corners --
Line 62, change “complementary” to -- complementarily --

Column 6,
Line 17, before “adjacent” remove “an”

Column 7,
Line 23, before “barrier” insert -- of --
Line 47, before “opening” change “a” to -- an --
Line 57, before “configured” insert -- is --

Column 8,
Line 28, change “though” to -- through --

Column 9,
Line 6, change “need” to -- needed --
Line 13, change “location” to -- located --
Line 23, change “configuration” to -- configurations --

Column 10,
Line 16, before “threadedly” insert -- to --

Column 11,
Lines 25, 32 and 65, change “baffler” to -- barrier --
Line 30, change “slideably” to -- slidably --
Line 61, before “control” remove “A”

UNITED STATES PATENT AND TRADEMARK OFFICE

CERTIFICATE OF CORRECTION

PATENT NO. : 6,676,113 B2
DATED : January 13, 2004
INVENTOR(S) : Christensen et al.

It is certified that error appears in the above-identified patent and that said Letters Patent is hereby corrected as shown below:

Column 12,
Lines 1, 2, 6, 12 and 14, change “baffler” to -- barrier --

Column 13,
Lines 5, 27 and 31, change “baffler” to -- barrier --
Line 13, before “pin” insert -- a --

Column 14,
Lines 6 and 58, before “pin” insert -- a --
Line 51, change “baffler” to -- barrier --

Signed and Sealed this

Twenty-seventh Day of July, 2004

JON W. DUDAS
*Acting Director of the United States Patent and Trademark Office*